US009039053B2

(12) United States Patent
Shoseyov et al.

(10) Patent No.: US 9,039,053 B2
(45) **Date of Patent: *May 26, 2015**

(54) APPARATUS AND METHOD FOR COLLECTING AND DISPOSING WASTE

(75) Inventors: Oded Shoseyov, Shoham (IL); Oded Halperin, Givatayim (IL)

(73) Assignee: Paulee Cleantec Ltd., Platinum Tower, Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/326,359

(22) Filed: Dec. 15, 2011

(65) Prior Publication Data

US 2012/0090516 A1 Apr. 19, 2012

Related U.S. Application Data

(63) Continuation-in-part of application No. 12/739,957, filed as application No. PCT/IL2008/001421 on Oct. 29, 2008, now Pat. No. 8,096,597.

(60) Provisional application No. 60/984,399.

(51) Int. Cl.

| | |
|---|---|
| ***A01K 29/00*** | (2006.01) |
| ***B09B 3/00*** | (2006.01) |
| ***F23G 5/40*** | (2006.01) |
| ***E01H 1/12*** | (2006.01) |

(52) U.S. Cl.
CPC ..... *F23G 5/40* (2013.01); *E01H 1/1213* (2013.01); *F23G 2900/7003* (2013.01)

(58) Field of Classification Search
USPC ..... 294/1.3–1.5, 176, 180, 54.5, 177; 15/257.1, 257.3, 257.4, 257.7, 257.9; 119/161; 4/111.5; 248/95, 99; 422/184.1, 307
See application file for complete search history.

(56) References Cited

U.S. PATENT DOCUMENTS

| | | | | |
|---|---|---|---|---|
| 3,924,547 | A * | 12/1975 | Werner | 110/192 |
| 4,182,267 | A * | 1/1980 | Kominami et al. | 119/226 |
| 4,229,410 | A * | 10/1980 | Kosti | 4/226.1 |
| 4,253,406 | A * | 3/1981 | Spitz et al. | 110/241 |
| 4,649,862 | A * | 3/1987 | Neary | 119/168 |
| 4,730,597 | A * | 3/1988 | Hottenroth et al. | 126/2 |
| 4,975,989 | A * | 12/1990 | Sutton | 4/300 |
| 5,228,923 | A * | 7/1993 | Hed | 136/208 |
| 5,400,443 | A * | 3/1995 | Marino | 4/300 |
| 5,485,637 | A * | 1/1996 | Green | 4/483 |
| 5,641,412 | A * | 6/1997 | Guy et al. | 210/758 |
| 6,458,319 | B1 * | 10/2002 | Caillat et al. | 420/576 |
| 6,945,180 | B1 * | 9/2005 | Khymych | 110/241 |
| 8,096,597 | B2 * | 1/2012 | Shoseyov et al. | 294/1.3 |
| 2003/0164600 | A1 * | 9/2003 | Dunn et al. | 280/47.34 |
| 2012/0204613 | A1 * | 8/2012 | Ba-abbad et al. | 422/184.1 |

FOREIGN PATENT DOCUMENTS

| | | | | |
|---|---|---|---|---|
| KR | 2001094195 | * | 3/2003 | B65F 1/14 |

* cited by examiner

*Primary Examiner* — Paul T Chin
(74) *Attorney, Agent, or Firm* — Dekel Patent Ltd.; David Klein

(57) ABSTRACT

Apparatus and methods for pet waste disposal include using a portable waste collection receptacle disposed on a handle. A heat source is mounted together with the waste collection receptacle, capable of incinerating waste disposed in the waste collection receptacle.

12 Claims, 2 Drawing Sheets

APPARATUS AND METHOD FOR COLLECTING AND DISPOSING WASTE

CROSS-REFERENCE TO RELATED APPLICATIONS

This application is a continuation-in-part of U.S. patent application Ser. No. 12/739,957, filed Apr. 27, 2010 now U.S. Pat. No. 8,096,597, which is a national phase application of, and claims priority under 35 USC §119 from, PCT Patent Application PCT/IL2008/001421, filed Oct. 29, 2008, which claims priority U.S. Provisional Patent Application Ser. No. 60/984,399, filed Nov. 1, 2007, which are incorporated herein by reference.

FIELD OF THE INVENTION

The present invention relatesly to disposing pet waste and the like and more particularly to improved apparatus and methods by which pet waste and the like may be disposed without soiling one's hands, while eliminating bad odor and microbial contamination.

BACKGROUND OF THE INVENTION

Due to increasing pet populations, certain large cities have adopted ordinances requiring pet owners to clean up after their pets. Even in areas where such cleanliness is not a prescribed ordinance, it is often desirable to dispose of pet waste and the like in order to maintain attractive lawns and streets which are safe to walk on without soiling one's shoes.

There have been various attempts to deal with these problems in the past. Some individuals have been known to place one of their hands inside a bag of flexible material, such as plastic, as if it were a glove, pick up the waste material using the "gloved" hand, and pull the end of the bag off of the hand in a manner so as to invert the bag around the waste material and package it for later disposal. However, this "gloved" hand method is esthetically unpleasing and otherwise unpleasant to the pet owner, particularly if the bag breaks at an opportune moment.

Other devices utilize a plastic bag and a frame, or multiple frames that may be collapsible and are used as scoops or shovels to place the waste material within the bag so that the bag may be inverted around the excrement and packaged for disposal. However, all these methods suffer from the fact that the waste is biologically active and therefore possess environmental hazards.

A gel composition containing oxidizing agents and thickening or gelling agents has also been proposed to detoxify chemical and biological agents by application directly to a contaminated area. The gelling agent is a colloidal material, such as silica, alumina, or alumino-silicate clays, which forms a viscous gel that does not flow when applied to tilted or contoured surfaces. After decontamination, the residue can be washed away or vacuumed up for disposal.

SUMMARY OF THE INVENTION

The present invention seeks to provide improved apparatus and methods for disposing pet waste by means of combustion, as described more in detail hereinbelow.

Animal droppings (pet waste, feces or exudates, the terms being used interchangeably) are composed of organic matter that in principle may be incinerated or at least sterilized to eliminate bacterial activity and bad odor. However, a major problem associated with fresh feces is their high water content that inhibits incineration and unfortunately provides a good medium for bacterial growth and propagation. Furthermore, the high water content makes the feces sticky and dirty. An attempt to burn fresh feces by an external heat source, such as a gas burner, is typically associated with a formation of external layer of inorganic matter that insulates the wet interior and inhibits heat transfer and combustion thereto. Efficient heat transfer to the interior parts of the feces and water evaporation therefrom are essential components of fecal disposal by heat.

The present invention solves these problems, as described more in detail below, by using a portable waste collection receptacle disposed on a handle, and a heat source mounted together with the waste collection receptacle, capable of incinerating or sterilizing waste disposed in the waste collection receptacle. An oxidizing agent (e.g., potassium permanganate) can be mixed with the waste to generate heat to the waste. This provides efficient heat transfer to the interior parts of the feces and water evaporation therefrom.

Accordingly, a user carries the waste collection receptacle to a place where the pet waste has been deposited, wherein a heat source is mounted together with the waste collection receptacle, capable of incinerating waste disposed in said waste collection receptacle; collects pet waste in the waste collection receptacle; and generates heat with the heat source to incinerate the pet waste disposed in the waste collection receptacle.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
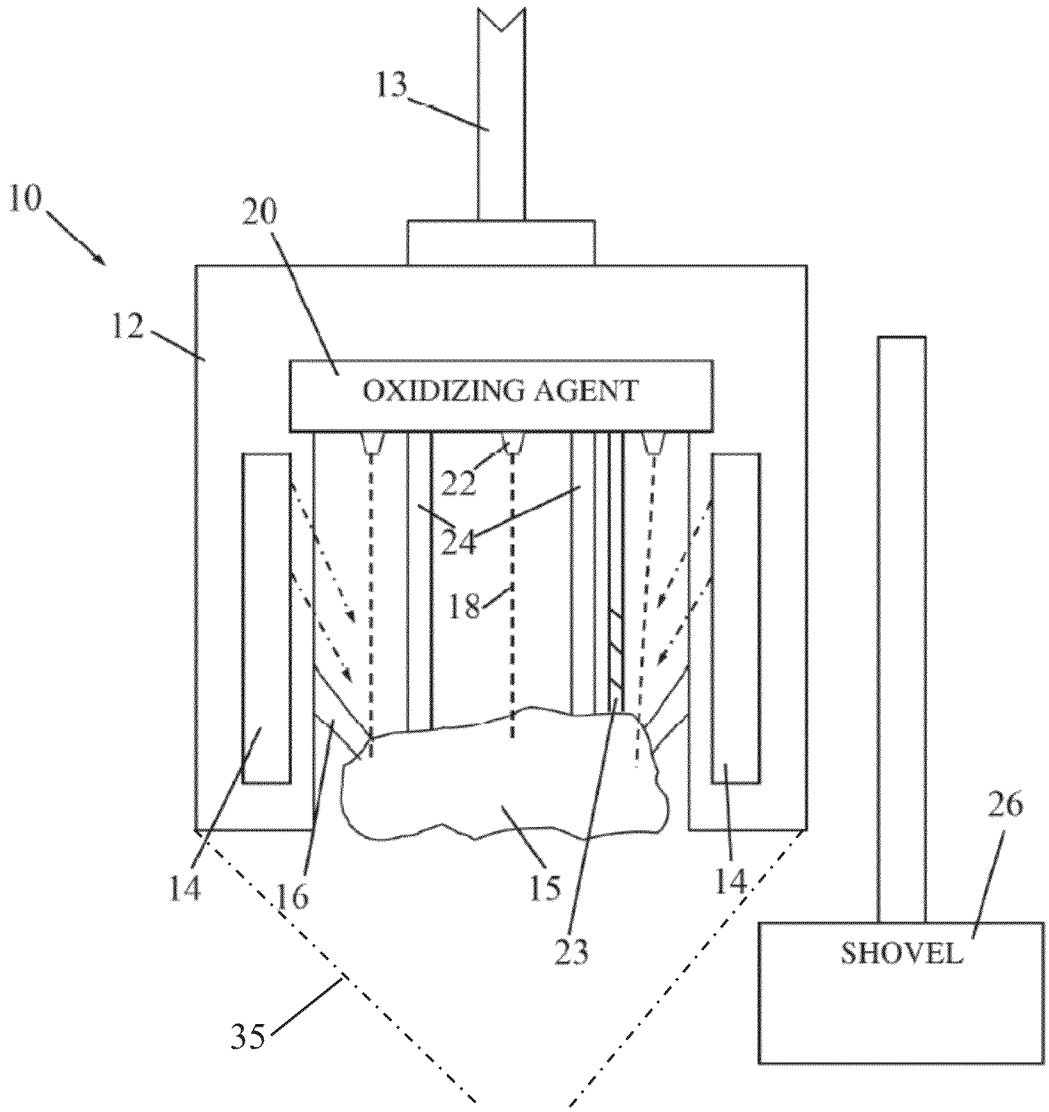
FIGS. 1 and 2 are simplified schematic and pictorial illustrations of apparatus for pet waste disposal, constructed and operative in accordance with an embodiment of the present invention.
Figure 2:
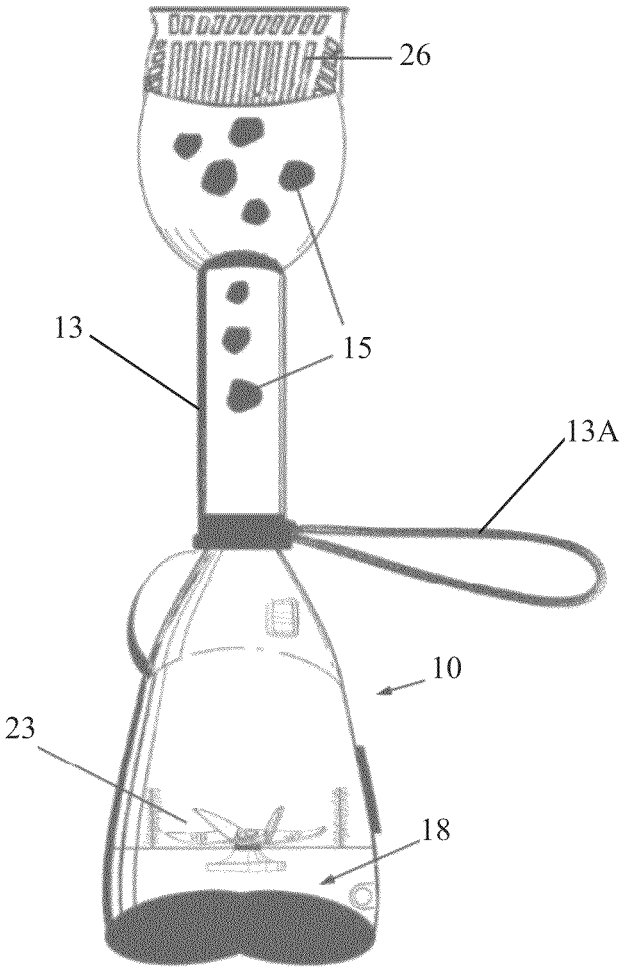

Reference is now made to FIGS. 1 and 2, which illustrate apparatus 10 for pet waste disposal, constructed and operative in accordance with an embodiment of the present invention.

Apparatus 10 may include a waste collection receptacle 12, which may be a chamber disposed at the end of a handle 13. (A carrying strap 13A may be connected to handle 13, as seen in FIG. 2.) Receptacle 12 may be open at an end (top or bottom) or side thereof, or may be closed with a hinged or trap door for allowing entry therein of feces and exit therefrom of ash or other combustion products (from the same inlet opening as collecting the waste, or a different exit opening). As shown in broken lines in FIG. 1, receptacle 12 may optionally include grabbing elements 35 for grabbing organic waste 15. Grabbing elements 35 may be scoopers and the like which are pivotally connected to receptacle 12.

Apparatus 10 includes a heat source 14 capable of incinerating or sterilizing waste 15. Heat source 14 may include, without limitation, a gas burner, oxidizing agent, laser heater, microwave heater, radiofrequency heater, electric resistance heater and the like, which is capable of drying and burning the organic waste 15 in a relatively short period of time without damaging the environment in general and the operator in particular. Heat transfer elements 16 (e.g., metal rods or plates) may be provided to contact or even pierce the waste 15 to accelerate heat transfer and water evaporation.

In a preferred embodiment, heat is generated by mixing the organic waste 15 with sufficient amount of an oxidizing agent 18, such as but not limited to, potassium permanganate or any other safe oxidizing agent. Oxidizing agent 18 may be stored in a compartment 20 in apparatus 10 and dispensed via one or more valves 22. Alternatively, oxidizing agent 18 may be manually dispensed by the operator from an external source (e.g., a bag carried by the operator). A mixing device 23 (such as but not limited to a beater, electrically or manually operated) may be provided for mixing oxidizing agent 18 with the feces.

In another embodiment, the device may contain one or more thermoelectric electrodes 24 that may convert heat to electricity by the Seebeck effect, i.e., the conversion of temperature differences directly into electricity. The electricity produced by the electrodes may be used for electrolysis of the water in the waste to molecular oxygen and molecular hydrogen that may contribute to the incineration of the organic waste. The electricity produced may also be used to charge a battery or operate an electrical device.

Additionally, apparatus 10 may include a collapsible shovel 26 that may be used to pick up the feces and dispose of the byproducts of combustion (mainly ash). Apparatus 10 may be constructed of light materials and have a telescopic body for folding into a small size convenient for carrying. Apparatus 10 may be operated in any open space, such as but not limited to, pavements, lawns, parks etc., without causing any damage.

In an experiment carried out with an embodiment of the invention, 50 gr of dog feces were mixed with about 20 gr of potassium permanganate. After about 20 seconds an exothermic reaction occurred, causing a temperature rise of about 100° C., and converting the feces to a dry odorless material which could be burned easily by a gas burner. The resulting ash was disposed directly on a green lawn. No phytotoxic signs were observed in a period of 30 days, indicating that the disposed material is environmentally safe.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A method of waste disposal comprising:

carrying a waste collection receptacle to a place where organic waste has been deposited, wherein a heat source is mounted together with said waste collection receptacle, capable of incinerating waste disposed in said waste collection receptacle;

collecting said organic waste in said waste collection receptacle; and generating heat with said heat source to incinerate said organic waste disposed in said waste collection receptacle, wherein generating heat with said heat source comprises mixing an oxidizing agent with said organic waste to cause an exothermic reaction.

2. The method according to claim 1, comprising generating heat to sterilize the organic waste.

3. The method according to claim 1, wherein said oxidizing agent comprises potassium permanganate.

4. The method according to claim 1, comprising dispensing said oxidizing agent with a dispenser.

5. Apparatus for organic waste disposal comprising:

a portable waste collection receptacle for entry therein of organic waste and exit therefrom of ash or other combustion products;

a carrying handle connected to, and protruding outwards from, said receptacle;

and a heat source mounted together with said waste collection receptacle, capable of incinerating waste disposed in said waste collection receptacle, wherein said heat source comprises an oxidizing agent mixed with said organic waste to cause an exothermic reaction.

6. The apparatus according to claim 5, wherein said heat source is capable of sterilizing the waste.

7. The apparatus according to claim 5, further comprising heat transfer elements that contact the waste to accelerate heat transfer and water evaporation.

8. The apparatus according to claim 5 wherein said oxidizing agent comprises potassium permanganate.

9. The apparatus according to claim 5 wherein said oxidizing agent is stored in a compartment in the apparatus and is dispensed via one or more valves.

10. The apparatus according to claim 5, further comprising one or more thermoelectric electrodes that convert heat to electricity.

11. The apparatus according to claim 5, further comprising a shovel for picking up the waste or for disposing byproducts of combustion.

12. The apparatus according to claim 5, wherein said receptacle comprises grabbing elements for grabbing the organic waste.

* * * * *